United States Patent [19]

Nishikawa et al.

[11] 4,227,233

[45] Oct. 7, 1980

[54] CORONA DISCHARGE DEVICE FOR ELECTROGRAPHIC APPARATUS

[75] Inventors: Masaji Nishikawa; Muneo Kasuga, both of Hachioji, Japan

[73] Assignee: Olympus Optical Company Limited, Tokyo, Japan

[21] Appl. No.: 838,233

[22] Filed: Sep. 30, 1977

[30] Foreign Application Priority Data

Oct. 1, 1976 [JP] Japan ..... 51/117118

[51] Int. Cl.[2] ..... G03G 15/00

[52] U.S. Cl. ..... 361/225; 361/230; 250/324

[58] Field of Search ..... 361/229, 230, 235, 225; 250/324, 325, 326

[56] References Cited

U.S. PATENT DOCUMENTS

| | | | |
|---|---|---|---|
| 3,303,401 | 2/1967 | Naumann et al. | 361/229 |
| 3,527,941 | 9/1970 | Culhane | 361/235 |
| 3,541,329 | 11/1970 | Roth | 361/235 |
| 3,554,161 | 1/1971 | Blanchette | 361/225 X |
| 3,594,162 | 7/1971 | Simm et al. | 361/225 |
| 3,660,656 | 5/1972 | Frank et al. | 361/235 |
| 3,739,246 | 6/1973 | Haas | 361/225 |
| 3,843,906 | 10/1974 | Leibrecht | 361/230 |
| 3,909,614 | 9/1975 | Marshall | 361/225 X |
| 3,967,891 | 7/1976 | Rippstein | 361/229 |
| 4,057,723 | 11/1977 | Sarid et al. | 361/225 X |
| 4,112,299 | 9/1978 | Davis | 361/225 X |

FOREIGN PATENT DOCUMENTS

| | | | |
|---|---|---|---|
| 2134698 | 1/1973 | Fed. Rep. of Germany | 361/229 |
| 48-18863 | 8/1973 | Japan | 361/230 |

OTHER PUBLICATIONS

*Research Disclosure,* Feb. 1974, "Corona Charger", by J. Y. Kaukeinen, pp. 28–29.

*Primary Examiner*—J. D. Miller
*Assistant Examiner*—L. C. Schroeder
*Attorney, Agent, or Firm*—Haseltine, Lake & Waters

[57] ABSTRACT

A corona discharge device for electrographic apparatus which makes use of a drum-shaped photosensitive screen. The device is provided with a corona electric field establishing electrode extending in parallel with a corona discharge wire and supplied with an electric potential which is intermediate the electric potential of a field electrode and the electric potential of the corona discharge wire.

8 Claims, 23 Drawing Figures

CORONA DISCHARGE DEVICE FOR ELECTROGRAPHIC APPARATUS

BACKGROUND OF THE INVENTION

1. Field of the Invention

This invention relates to a corona discharge device for electrographic apparatus which makes use of a drum-shaped photosensitive screen.

2. Description of the Prior Art

A corona discharge device heretofore known in general, comprises a corona discharge wire, a shield electrode surrounding the corona discharge wire and having an opening and a field electrode opposed through the opening to the corona discharge wire. Between the field electrode and the corona discharge wire is applied a high voltage and both the shield electrode and field electrode are connected to ground. A flow of corona ions is directed to the shield electrode and to the field electrode to charge a record sheet or the like placed on the field electrode.

An electric current produced by the flow of corona ions directed to the field electrode is effective to charge the record sheet, while an electric current produced by the flow of corona ions directed to the shield electrode is an ineffective current. Experimental tests have shown that a current produced by a high voltage source mainly consists of the ineffective current and hence the effective current is very small. As a result, the conventional corona discharge device is extremely low in current utility efficiency.

In addition, since the shield electrode is connected to ground, a high voltage applied to the corona discharge wire results in spark discharge between the corona discharge wire and the shield electrode. As a result, the highest voltage applicable to the corona discharge wire is limited by the distance between the corona discharge wire and the shield electrode. If it is necessary to obtain a large effective current, the distance between the corona discharge wire and the shield electrode must be made great, thereby making the corona discharge device large in size.

In an electrographic apparatus which makes use of a drum-shaped photosensitive screen, in the case of using the corona discharge device for the purpose of transferring an electrostatic latent image produced on the photosensitive screen onto a dielectric coated record sheet, there is the risk that an image consisting of dots and produced on the dielectric coated record sheet will be subjected to strain or the dots will be enlarged by the diverging flow of corona ions directed to the field electrode and hence increasing the width of the imagewise charged area on the field electrode. As a result, it is necessary to reduce the electric source voltage applied to the corona discharge device and hence to reduce the recording speed in the case of transferring the electrostatic latent image on the photosensitive screen onto the dielectric coated record sheet. As a result, provision must be made for a corona discharge device which can produce a flow of corona ions having a high density.

SUMMARY OF THE INVENTION

An object of the invention, therefore, is to provide a corona discharge device for electrographic apparatus which makes use of a drum-shaped photosensitive screen, which can produce a flow of corona ions which is high in density and can produce an imagewise charged area of narrow width on a field electrode.

Another object of the invention is to provide a corona discharge device which can utilize an electric current applied from an electric source in a highly efficient manner and hence provides a material decrease in capacity of the electric source.

A further object of the invention is to provide a corona discharge device which produces a small quantity of ozone and hence has substantially no advance influence due to the production of ozone.

A feature of the invention is the provision in a corona discharge device comprising at least one corona discharge wire, a field electrode for producing a backing electrode field and a high voltage source connected between the corona discharge wire and the field electrode, of the improvement comprising a corona electric field establishing electrode arranged between the corona discharge wire and the field electrode and having at least one portion extending in parallel with the corona discharge wire and establishing a corona electric field, the corona electric field establishing electrode being supplied with an electric potential which is intermediate the electric potential of the field electrode and the electric potential of the corona discharge wire.

The invention will now be described in greater detail with reference to the accompanying drawings.

DESCRIPTION OF THE PREFERRED EMBODIMENTS

Figure 1A:
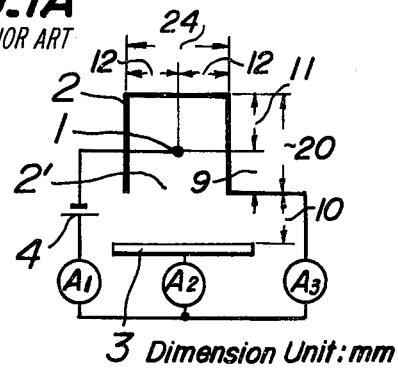
FIG. 1A PRIOR ART
FIG. 1A is a schematic diagram of one example of a prior art corona discharge device.

In FIG. 1A is shown an example of a prior art corona discharge device.

In the example, a corona discharge wire 1 is surrounded by a channel-shaped shield electrode 2 provided at its bottom with an opening 2'. Between a field electrode 3 opposed to the opening 2' of the shield electrode 2 and the corona discharge wire 1 is connected a high voltage source 4. Both the shield electrode 2 and the field electrode 3 are grounded. A flow of corona ions is directed to both the shield electrode 2 and the field electrode 3 to charge a record sheet or the like placed on the field electrode 3.

In the corona discharge device constructed as above described and having the dimensions shown in FIG. 1A, when a high voltage Vc of the high voltage source 4 is applied to the corona discharge wire 1, a current $A_1$ flows due to the high voltage Vc, a current $A_2$ flows due to the flow of corona ions directed to the field electrode 3 and a current $A_3$ flows due to the flow of corona ions directed to the shield electrode 2. These currents $A_1$, $A_2$ and $A_3$ were measured.

Figure 1B:
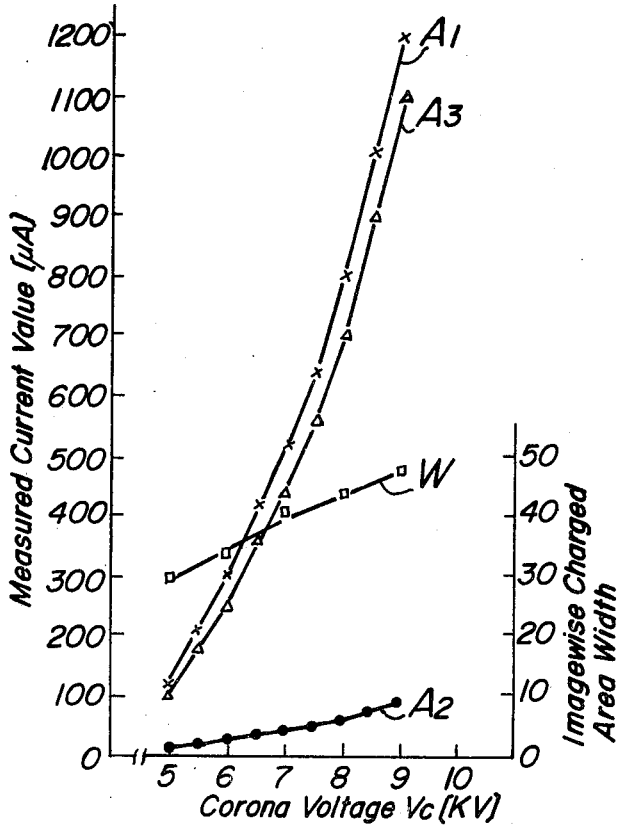
FIG. 1B PRIOR ART
FIG. 1B is a graph illustrating various characteristics of the corona discharge device shown in FIG. 1A.

In FIG. 1B is shown a graph illustrating the operating characteristics of the currents $A_1$, $A_2$ and $A_3$. The current $A_2$ produced by the flow of corona ions directed to the field electrode 3 is an effective current which functions to charge the record sheet, while the current $A_3$ produced by the flow of corona ions directed to the shield electrode 2 is an ineffective current. As seen from the measurement result shown in FIG. 1B, in the prior art corona discharge device, the current $A_1$ produced by the high voltage Vc consists mainly of the ineffective current $A_3$, so that the effective current $A_2$ is very small and hence the operating efficiency of such corona discharge device becomes extremely low.

Since the shield electrode 2 is grounded, if the voltage applied to the corona discharge wire 1 is made too high, a spark discharge occurs between the corona discharge wire 1 and the shield electrode 2. As a result, the highest voltage that may be applied to the corona discharge wire 1 is limited by the distance between the corona discharge wire 1 and the shield electrode 2.

If it is required to increase the effective current $A_2$, the distance between the corona discharge wire 1 and the shield electrode 2 must be made great. The prior art corona discharge device, therefore, has the disadvantage that it becomes large in size.

In the prior art electrographic apparatus which makes use of a drum-shaped photosensitive screen, there occurs a divergence of the flow of corona ions directed from the corona discharge wire to the field electrode so as to produce an imagewise charged area of large width on the field electrode when an electrostatic latent image produced on the photosensitive screen is transferred as an image consisting of a number of dots onto a dielectric coated record sheet. As a result, there is a risk that the image produced on the dielectric-coated record sheet will be subjected to strain or the dot will be enlarged. In order to prevent such drawback, the imagewise charged area must be made narrow.

In FIG. 1B, curve W shows a measured value of the imagewise charged area width W on the field electrode 3. As seen from FIG. 1B, the imagewise charged area width W increases in relation to the corona voltage Vc and hence with the dimension of the shield electrode 2. As a result, the use of the prior art corona discharge device for the image transfer region of the electrographic apparatus provides the above mentioned drawbacks. If the corona voltage Vc is reduced for the purpose of making the imagewise charged area width W narrow, the recording speed in the case of transferring the electrostatic latent image onto the dielectric coated record sheet must be made low. Thus, provision must be made of a corona discharge device which can produce a flow of corona ions having a high density.

The present invention seeks to provide a corona discharge device which can eliminate the above described drawbacks which have been encountered with the prior art techniques.

The principle of the corona discharge device according to the invention will now be described with reference to FIGS. 2 to 6.

Figure 2:
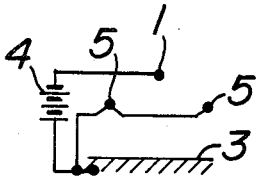
FIG. 2 PRIOR ART
FIGS. 2 to 6 illustrate schematically the principle of a corona discharge device according to the invention.

In FIG. 2 is shown one example of a prior art corona discharge device. In this device, near the corona discharge wire 1 are arranged two wire electrodes 5,5 for the corona electric field which are spaced from each other and symmetrically arranged with respect to the corona discharge wire 1. On the side of these electrodes 5, 5 opposite from the corona discharge wire 1 is arranged a field electrode 3. Between the corona discharge wire 1 and the field electrode 3 is connected a high voltage source 4 so as to apply a high voltage therebetween. The electrodes 5, 5 are electrically connected to the field electrode 3 to make these electrodes 5, 3 equal in electric potential.

Figure 3:
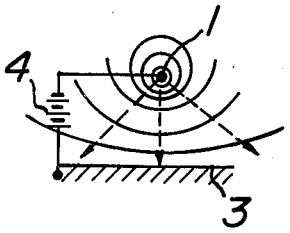
FIG. 3 PRIOR ART
Figure 4:
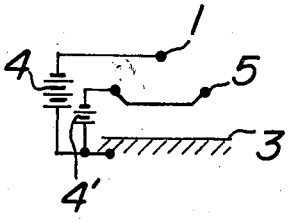
Figure 5:
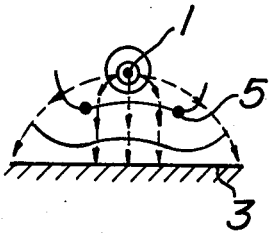

In FIG. 3 is shown in solid lines equipotential lines of an electric field strength distribution established by the electric potential of the corona discharge wire 1 and the electric potential of the corona electric field establishing electrodes 5, 5 and field electrode 3. A flow of corona ions directed from the corona discharge wire 1 travels in directions perpendicular to the equipotential lines as shown by the dotted arrow lines. As seen from FIG. 3, the imagewise charged area width on a record sheet etc. (not shown) positioned in overlying contact with the field electrode 3 becomes widened.

In order to prevent such drawback, in accordance with the invention, between the two wire electrodes 5, 5 and the field electrode 3 is connected an auxiliary voltage source 4' so as to apply to the electrodes 5, 5 an electric potential intermediate the electric potential of the corona discharge wire 1 and the electric potential of the field electrode 3. In this case, an equipotential line of an electric field strength distribution established by the electric potential of the corona discharge wire 1 and the electric potential of the corona electric field establishing electrodes 5, 5 is changed into that shown in full lines in FIG. 5. A flow of corona ions is mainly directed from the corona discharge wire 1 through a space between the electrodes 5, 5 to the field electrode 3 as shown by dotted line arrows, the remainder of the flow of corona ions traveling the outside of the electrodes 5, 5 to the field electrode 3.

Figure 6:
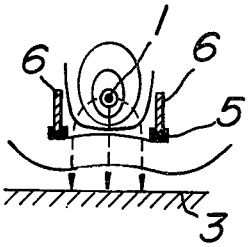

In accordance with the invention, in order to prevent flow of corona ions from traveling the outside of the electrodes 5, 5 to the field electrode 3, provision is made, as shown in FIG. 6, of a plate-shaped insulating member 6 secured to the electrode 5 and projecting upwardly therefrom. In this case, an equipotential line of an electric field strength distribution established by the electric potential of the corona discharge wire 1 and the electric potential of the electrodes 5, 5 and field electrode 3 becomes that as shown by the solid lines and the flow of corona ions is in the direction as shown by the dotted lines. As a result, it is possible to make the imagewise charged area on the record sheet narrow and to make the density of the flow of corona ions high.

Figure 7:
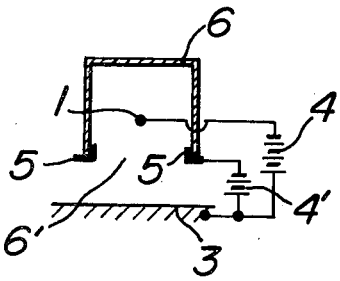
FIGS. 7 to 12 are schematic diagrams of various embodiments of a corona discharge device according to the invention.

In FIG. 7 is shown one embodiment of a corona discharge device constructed on the basis of the principle illustrated with reference to FIGS. 2 to 6 according to the invention. In this embodiment, the corona discharge wire 1 is surrounded by a channel-shaped insulating member 6 provided at its base with an opening 6'. Opposite the opening 6' of the insulating member 6 is a field electrode 3. The insulating member 6 is provided at its lower ends defining the opening 6' with an electrode 5 for establishing the corona electric field and extending in parallel with the corona discharge wire 1. The electrode may be in the shape of a wire, i.e. of circular cross-section or it may be in the form of a band, i.e. of flat or rectangular cross-section. The field electrode 3 is grounded. Between the corona discharge wire 1 and the field electrode 3 is connected high voltage source 4 so as to apply a high electric potential to the corona discharge wire 1. Between the corona electric field establishing electrode 5 and the field electrode 3 is connected auxiliary voltage source 4' so as to apply an electric potential intermediate the electric potential of the field electrode 3 and the electric potential of the corona discharge wire 1. The corona discharge device constructed as above described makes it possible to make the imagewise charged area width narrow to increase the density of the flow of corona ions.

Figure 8:
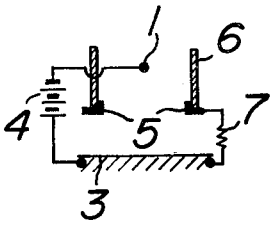

In FIG. 8 is shown another embodiment of a corona discharge device according to the invention. In this embodiment, between the corona electric field establishing electrode 5 and the field electrode 3 is connected a high resistor 7 so as to produce a voltage drop across the resistor 7 by means of an electric current caused by a flow of corona ions directed from the corona discharge wire 1 to the corona electric field establishing electrode 5, thereby applying to the electrode 5 an electric potential intermediate the electric potential of the field electrode 3 and the electric potential of the corona discharge wire 1.

Figure 9:
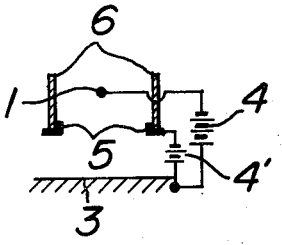

In FIG. 9 is shown a further embodiment of a corona discharge device according to the invention. In this embodiment, between field electrode 3 and corona electric field establishing electrode 5 is connected auxiliary high voltage source 4' which is independent of the high voltage source 4 connected between the field electrode 3 and a corona discharge wire 1, thereby applying to the corona electric field establishing electrode 5 an electric potential intermediate the electric potential of the field electrode 3 and the electric potential of the corona discharge wire 1.

Figure 10:
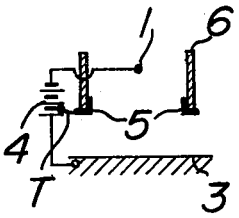

In FIG. 10 is shown a still further embodiment of a corona discharge device according to the invention. In the embodiment, high voltage source 4 is provided with an intermediate tap T which is connected to the corona electric field establishing electrode 5 for the purpose of applying to the electrode 5 an electric potential intermediate the electric potential of the field electrode 3 and the electric potential of a corona discharge wire 1.

Figure 11:
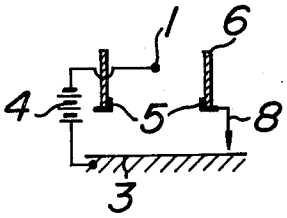

In FIG. 11 is shown another embodiment of a corona discharge device according to the invention. In this embodiment, provision is made of an aerial discharge device composed of a needle electrode 8. The needle electrode 8 is opposite field electrode 3 and spaced therefrom and is electrically connected to one of the corona electric field establishing electrodes 5 for the purpose of utilizing the discharge phenomenon of the needle electrode 8 and applying to the corona electric field establishing electrode 5 an electric potential intermediate the electric potential of the field electrode 3 and the electric potential of the corona discharge wire 1. That is, when a flow of corona ions directed from the corona discharge wire 1 arrives at the corona electric field establishing electrode 5, the electric potential of the electrode 5 becomes high and at the same time the potential of the needle electrode 8 also becomes high, thereby producing a discharge between the needle electrode 8 and the field electrode 3. As a result, the electric potential of the corona electric field establishing electrode 5 can be made substantially constant at a value intermediate the electric potential of the field electrode 3 and the electric potential of the corona discharge wire 1.

Figure 12:
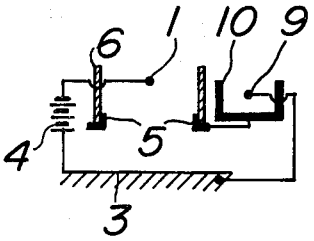

In FIG. 12 is a further embodiment of a corona discharge device according to the invention. In the present embodiment, provision is made of an aerial discharge device composed of an auxiliary corona discharge device provided with the corona discharge wire 9 connected to a field electrode 3 and with a shield electrode 10 connected to a corona electric field establishing electrode 5. Similar to the needle electrode 8 shown in FIG. 11, when a flow of corona ions directed from the corona discharge wire 1 arrives at the corona electric field establishing electrode 5, the electric potential of the electrode 5 becomes high and at the same time the potential of the shield electrode 10 of the auxiliary corona discharge device also becomes high, thereby producing a discharge between the shield electrode 10 and the corona discharge wire 9 of the auxiliary corona discharge device. As a result, the electric potential of the corona electric field establishing electrode 5 can be made substantially constant at a value intermediate the electric potential of the field electrode 3 and the electric potential of the corona discharge wire 1. In this case, a flow of corona ions directed from the corona discharge wire 9 to the shield electrode 10 of the auxiliary corona discharge device is only used for the purpose of producing the discharge therebetween.

Figure 13A:
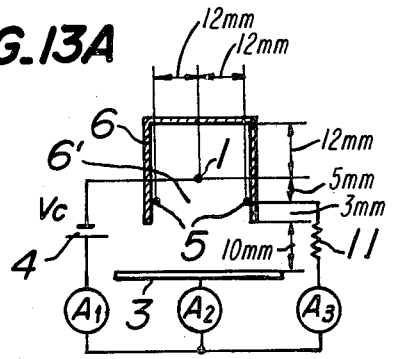
FIG. 13A is a schematic diagram of another embodiment of a corona discharge device according to the invention.
Figure 13B:
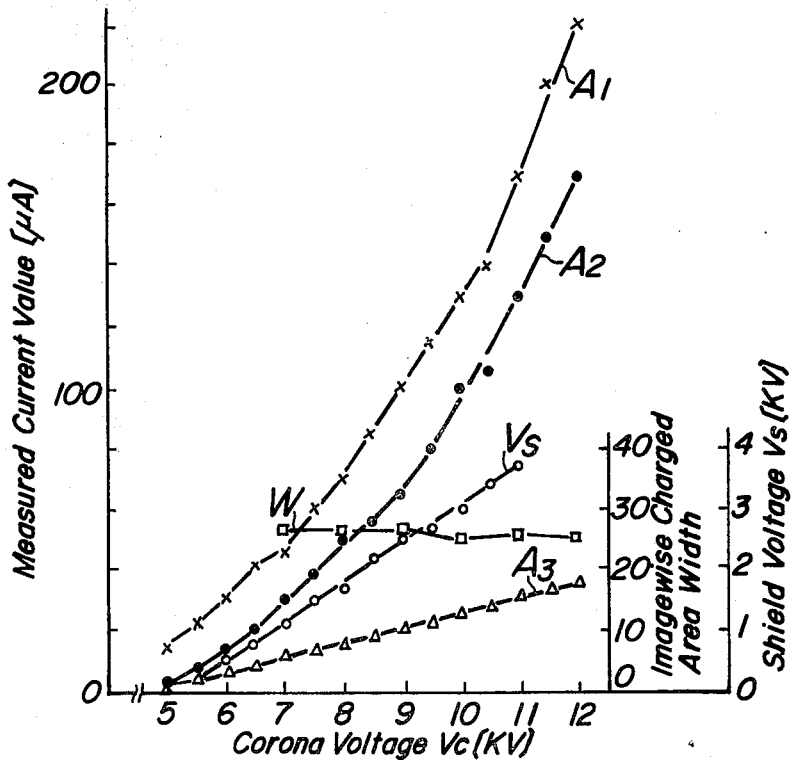
FIG. 13B is a graph illustrating various characteristics of the corona discharge device shown in FIG. 13A.

In FIG. 13A is shown a still further embodiment of a corona discharge device according to the invention. In this embodiment, the corona discharge wire 1 is surrounded by channel-shaped insulating member 6 provided at its base with an opening 6' opposite which is opposed a plate-shaped field electrode 3. The insulating member 6 is provided near its lower inner ends with two wire electrodes 5, 5 for establishing an electric field for directing a flow of corona ions. Between the corona discharge wire 1 and the field electrode 3 is connected the high voltage source 4 so as to apply a high voltage Vc therebetween. Between the corona electric field establishing electrode 5 and the field electrode 3 is connected a high voltage resistor 11 having a resistance value of 120 MΩ. Such corona discharge device was manufactured such that the various parts thereof have the dimensions shown in FIG. 13A. The following values were measured; current $A_1$ produced by the high voltage Vc, current $A_2$ produced by the flow of corona ions directed to the field electrode 3, current $A_3$ produced by the flow of corona ions directed to the corona electric field establishing electrode 5, the voltage Vs applied to the electrode 5 and the width W of the imagewise charged area on the field electrode 3. The values thus measured were plotted on the graph shown in FIG. 13B.

Figure 14A:
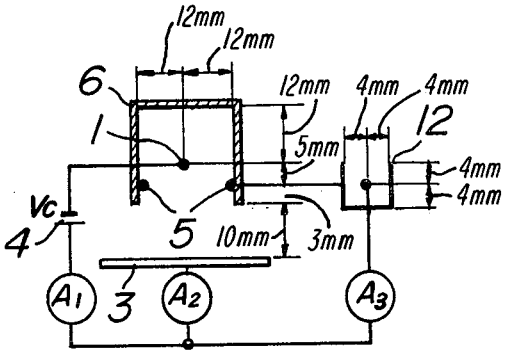
FIG. 14A is a schematic diagram of a further embodiment of a corona discharge device according to the invention.
Figure 14B:
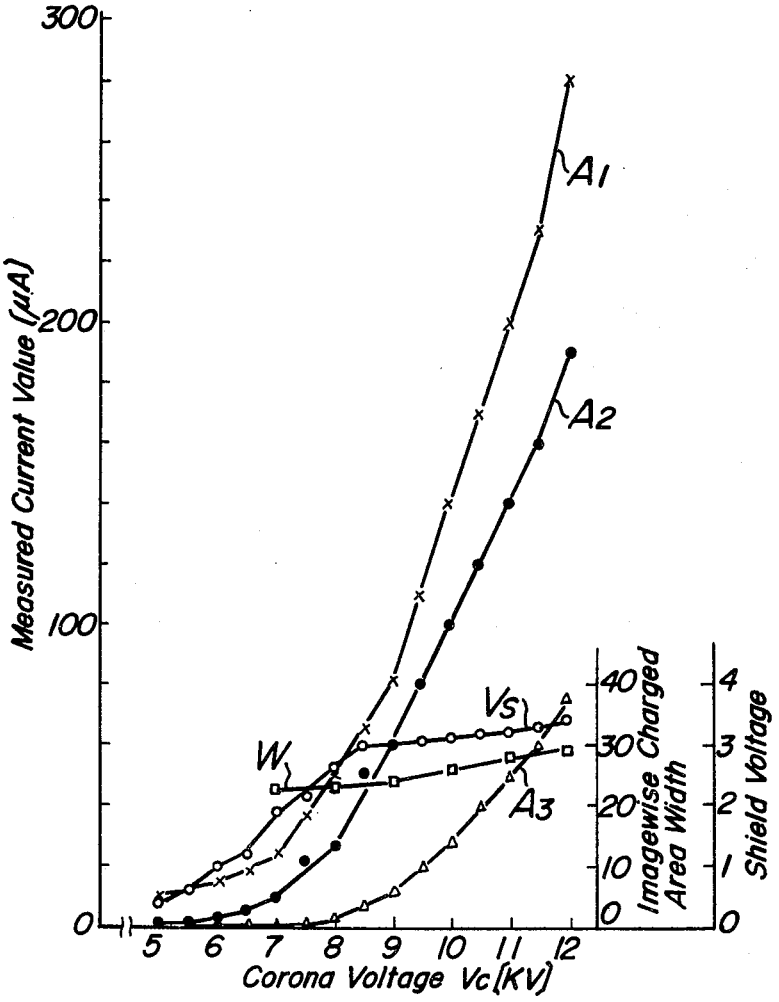
FIG. 14B is a graph illustrating various characteristics of the corona discharge device shown in FIG. 14A.

In FIG. 14A is shown another embodiment of a corona discharge device according to this invention. In the embodiment, between the corona electric field establishing electrode 5 and the field electrode 3 is connected an aerial discharge device composed of an auxiliary corona discharge device 12 instead of the resistor 11 shown in FIG. 13A. The corona discharge device was manufactured such that the various parts thereof have the dimensions as shown in FIG. 14A. The following values were measured; the current $A_1$ produced by the high voltage Vc, the current $A_2$ produced by the flow of corona ions directed to the field electrode 3, the current $A_3$ produced by the flow of corona ions directed to the corona electric field establishing electrode 5, the voltage applied to the electrode 5 and the width W of the imagewise charged area on the field electrode 3. The values thus measured were plotted on the graph shown in FIG. 14B.

Figure 15A:
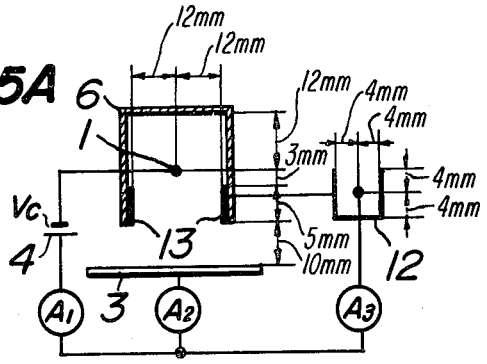
FIG. 15A is a schematic diagram of a still further embodiment of a corona discharge device according to the invention.

In FIG. 15A is shown a further embodiment of a corona discharge device according to the invention. In this embodiment, provision is made of a flat or band-shaped electrode 13 as the corona electric field establishing electrode instead of the wire electrode 5 shown in FIG. 14A, the other parts being the same as those of the corona discharge device shown in FIG. 14A. The measured values were the current $A_1$ produced by the high voltage Vc, the current $A_2$ produced by the flow of corona ions directed to the field electrode 3 the current $A_3$ produced by the flow of corona ions directed to the band-shaped electrode 13, the voltage Vs induced in the band-shaped electrode 13 and the width W of the imagewise charged area on the field electrode 3.

Figure 15B:
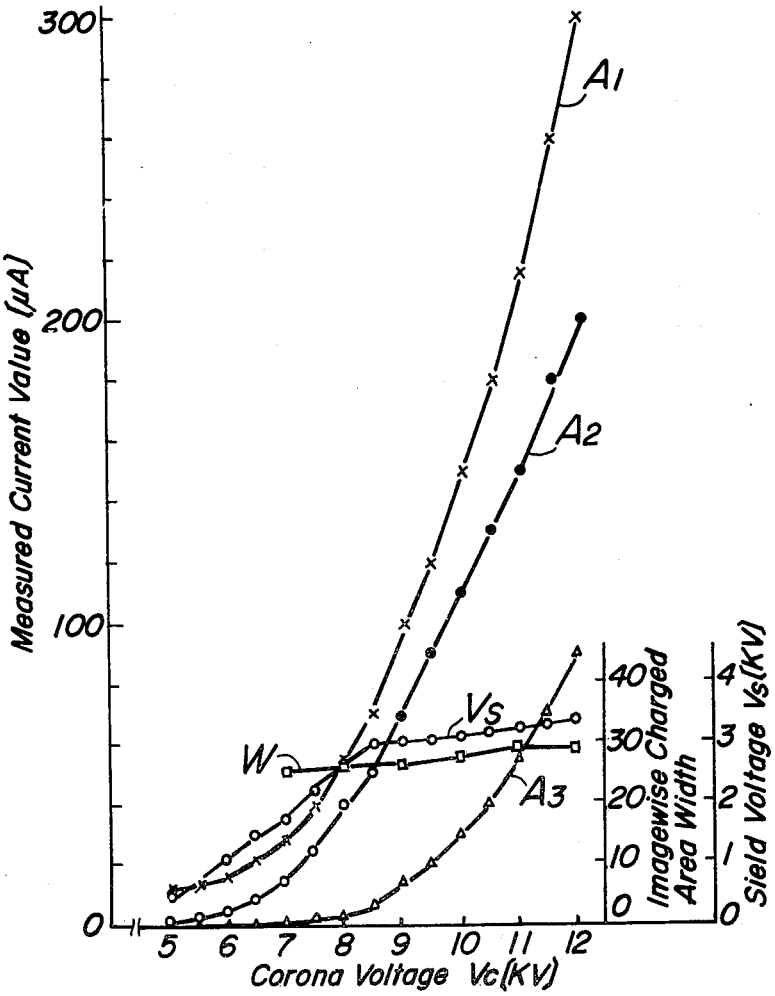
FIG. 15B is a graph illustrating various characteristics of the corona discharge device shown in FIG. 15A.

In FIG. 15B is shown an explanatory graph of the currents $A_1$, $A_2$, $A_3$, the shield voltage Vs and the imagewise charged area width W thus measured as a function of the corona voltage Vc.

Figure 16A:
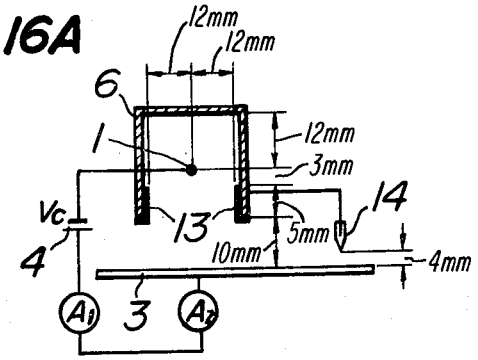
FIG. 16A is a schematic diagram of another embodiment of a corona discharge device according to the invention.

In FIG. 16A is shown a still further embodiment of a corona discharge device according to the invention. In this embodiment, provision is made of a band-shaped electrode 13 as the corona electric field establishing electrode in the same manner in the embodiment shown in FIG. 15A and a needle electrode 14 is employed instead of the auxiliary corona discharge device 12 as shown in FIG. 15A, the needle electrode 14 being opposite the field electrode 3 and spaced therefrom. The measured values were the current $A_1$ produced by the high voltage Vc, current $A_2$ produced by the flow of corona ions directed to the field electrode 3 and the width W of the imagewise charged area on the field electrode 3.

Figure 16B:
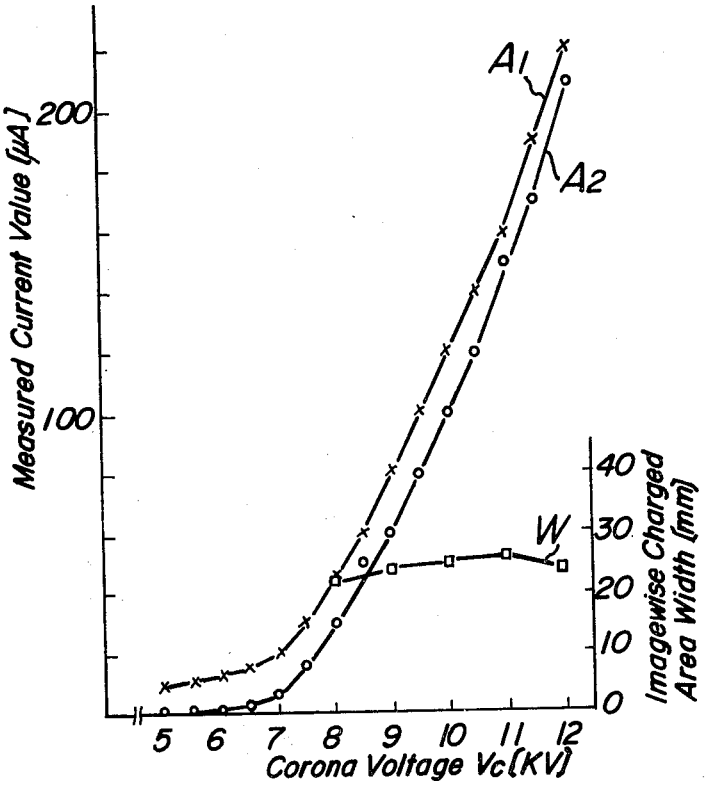
FIG. 16B is a graph illustrating various characteristics of the corona discharge device shown in FIG. 16A.

In FIG. 16B is shown the explanatory graph of the currents $A_1$, $A_2$ and the imagewise charged area width W thus measured as a function of the corona voltage Vc.

Figure 17A:
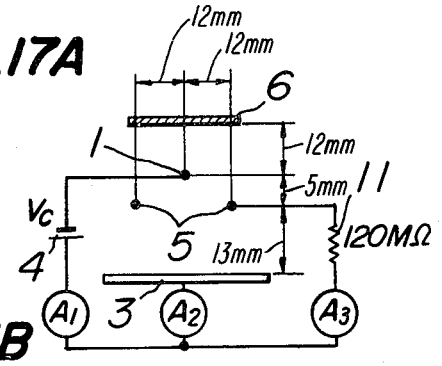
FIG. 17A is a schematic diagram of a further embodiment of a corona discharge device according to the invention.

In FIG. 17A is shown another embodiment of a corona discharge device according to the invention. In the embodiment, provision is made of a plate-shaped insulating member 6 instead of the channel-shaped insulating member 6 shown in FIG. 13A, the other parts being the same as those shown in FIG. 13A. The measured values were the current $A_1$ by the produced high voltage Vc, the effective current $A_2$ produced by the flow of corona ions directed to the field electrode 3 and the ineffective current $A_3$ produced by the flow of corona ions directed to the plate-shaped insulating member 6.

Figure 17B:
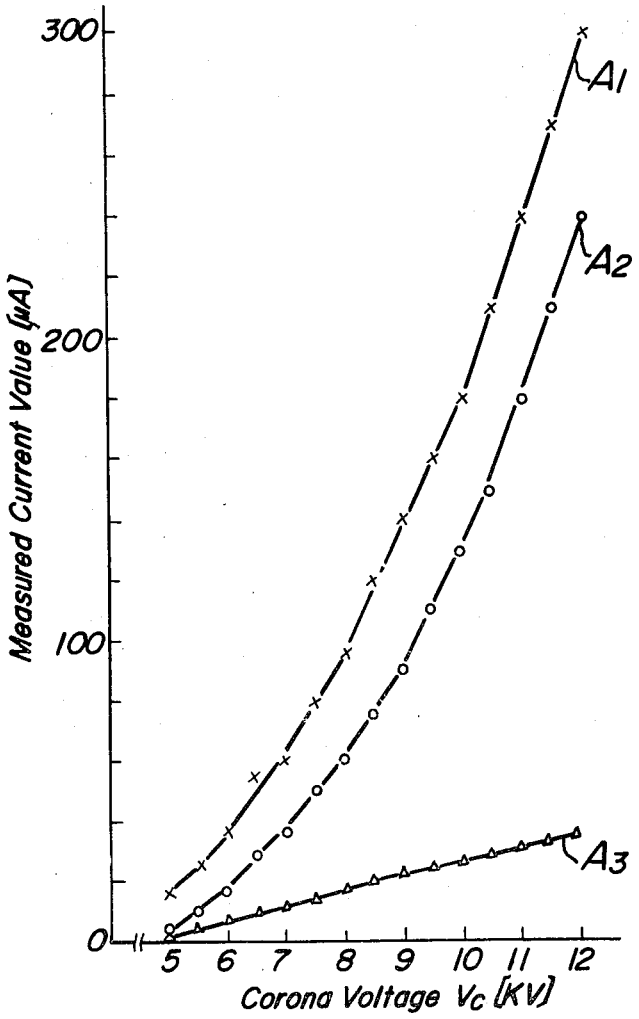
FIG. 17B is a graph illustrating various characteristics of the corona discharge device shown in FIG. 17A.

In FIG. 17B is shown the explanatory graph of the currens $A_1$, $A_2$, $A_3$ thus measured as a function of the corona voltage Vc.

As seen from FIGS. 13B, 14B, 15B, 16B and 17B, the corona discharge device according to the invention is capable of significantly reducing the value of the ineffective current $A_3$ flowing between the corona discharge wire 1 and the corona electric field establishing electrode 5 or 13 as compared with the conventional corona discharge device, the ineffective current $A_3$ being smaller than the effective current $A_2$ flowing between the corona discharge wire 1 and the field electrode 3. As a result, the ratio of the current effectively used for charging the record sheet to the current discharged at the corona high voltage source 4 becomes very large, thereby providing a corona discharge device having a very high efficiency of current utilization. In addition, the use of an extremely small ineffective corona current ensures an extremely small generation of ozone. In addition, the corona discharge device according to the invention makes it possible to reduce the width of the imagewise charged area on the field electrode as compared with the conventional corona discharge device. Since the effective corona current is concentrated into the narrow width of the imagewise charged area on the field electrode, it is possible to increase the density of the flow of corona ions.

The invention is not limited to the above described embodiments and various modifications and alternations may be made. For example if it is not particularly necessary to limit the width of the imagewise charged area, the corona discharge wire 1 may be shielded by the plate-shaped insulating member 6 as shown in FIG. 17A. In this case also, it is possible to significantly improve the efficiency of utilizing the effective current $A_2$. In addition, if the insulating member 6 is made transparent, the record sheet can be exposed to light at the same time as it is charged. Such simultaneous exposure and charging can be effected by the various embodiments shown in FIGS. 7 to 12. In addition, the number of the corona electric field establishing electrodes 5, 13 is not limited to two, and use may be made of a greater number of these electrodes. These electrodes may also be mesh-shaped or lattice-shaped. Use may also be made of a plurality of corona discharge wires instead of using one corona discharge wire.

The corona discharge device according to the invention has a number of advantages. In the first place, the device has a high current utilizing efficiency and hence provides a material decrease in current capacity of the high voltage source, thereby making the corona discharge device less expensive. Secondly, since the imagewise charged area width on the field electrode is narrow and the density of the flow of corona ions is high, the device can effectively be applied to an electrographic apparatus which makes use of a photosensitive screen. Thirdly, even when a narrow imagewise charged area on the field electrode is not required, the use of the corona electric field establishing electrode supplied with the intermediate voltage ensures an application of a high voltage to the corona discharge wire without producing any spark discharge. Finally, since there is no effect of an electric potential difference between the field electrode and the corona discharge wire, it is possible to provide a corona discharge device having a high capability by utilizing a voltage source having a higher output voltage.

What is claimed is:

1. In a corona discharge device for electrographic apparatus employing a corona discharge wire, a field electrode for establishing a backing electric field and a high voltage source connected between said corona discharge wire and said field electrode, the improvement comprising: two corona electric field establishing electrodes (5, 5; 13, 13) are provided without any other electrically conductive electrode, said two electrodes (5, 5; 13, 13) being formed of two thin bar-shaped conductors, spaced apart from each other and arranged between said corona discharge wire (1) and said field electrode (3) in such a position that a flow of corona ions directed from said corona discharge wire (1) directly toward said field electrode (3) passes between said two electrodes (5, 5; 13, 13) without being disturbed by said two electrodes (5, 5; 13, 13), and means for applying an electrical potential intermediate between a potential of said corona discharge wire (1) and a potential of said field electrode (3) to said corona electric field establishing electrodes (5, 5; 13, 13).

2. The device according to claim 1 wherein said means comprises an auxiliary high voltage source connected between said corona electric field-establishing electrode and said field electrode for applying said intermediate electric potential to said corona electric field-establishing electrode.

3. The device according to claim 1 wherein said means comprises a high voltage resistor connected between said corona electric field-establishing electrode and said field electrode for applying said intermediate electric potential to said corona electric field-establishing electrode.

4. The device according to claim 1 wherein said means comprises an aerial discharge device connected between said corona electric field-establishing electrode and said field electrode and applying said intermediate electric potential to said corona electric field establishing electrode.

5. The device according to claim 4, wherein said aerial discharge device comprises a needle electrode having one end connected to said corona electric field establishing electrode, the other end of said needle electrode being opposite to said field electrode with a discharge gap therebetween.

6. The device according to claim 4, wherein said aerial discharge device comprises an auxiliary corona discharge device having a shield electrode connected to said corona electric field-establishing electrode and a corona discharge wire connected to said field electrode.

7. The device according to claim 1 further comprising two insulating members for shielding that flow of corona ions which is directed from said corona discharge wire 1 through the outside of said two corona electric field establishing electrodes 5, 5; 13, 13 toward said field electrode 3 and arranged at both sides of and extending parallel to said corona discharge wire and arranged adjacent to said two corona electric field-establishing electrodes, respectively.

8. The device according to claim 1 further comprising a channel-shaped insulating member for shielding that flow of corona ions which is directed from said corona discharge wire 1 through the outside of said two corona electric fields establishing electrodes 5, 5; 13, 13 toward said field electrode 3 and arranged parallel with said corona discharge wire in surrounding relation therewith, said insulating member having parallel legs with free edges defining an open end for the channel-shaped insulating member, said two corona electric field-establishing electrodes being arranged adjacent to said free edges at said open end of said channel-shaped insulating member, respectively.

* * * * *